United States Patent [19]

Rouse

[11] 4,095,500

[45] Jun. 20, 1978

[54] ANGLE CUTTING GUIDE

[76] Inventor: William W. Rouse, 22 Bedinger Ave., Walton, Ky. 41094

[21] Appl. No.: 763,330

[22] Filed: Jan. 28, 1977

[51] Int. Cl.[2] ..... B27G 5/02
[52] U.S. Cl. ..... 83/762
[58] Field of Search ..... 83/762, 761

[56] References Cited

U.S. PATENT DOCUMENTS

| | | | |
|---|---|---|---|
| 731,919 | 6/1903 | Larson | 83/762 |
| 3,545,507 | 12/1970 | Brownrigg | 83/761 |

*Primary Examiner*—Donald R. Schran

[57] ABSTRACT

The present invention relates to an accurate, inexpensive angle cutting guide for use in carpentry which gives a saw a rigid and perfect guide for any 45° or 90° cut, whether said cut be horizontal or perpendicular.

1 Claim, 5 Drawing Figures

ANGLE CUTTING GUIDE

SUMMARY OF THE INVENTION

The present invention relates to an improved angle cutting guide for use by carpenters and others in making miter joints, particularly for mitering picture, cove, casing and base mouldings. The general improvement lies in utilizing a solid mass attached as a cutting guide to a base board. This structure with its inherent rigidity gives durability, strength and precision to the angle cutting guide, all of which aid in achieving precision in the mitering of joints. The present invention gives a saw a rigid and perfect guide for any 45° or 90° cut, whether said cut be horizontal or perpendicular. This solid mass permits the work area of the guide to be open, and thus, enables the user to hold the work-piece in a rigid position with his hand, preventing the movements of the work-piece and enabling the user to cut the work-piece at the correct angle. The use of the solid mass allows full visibility of the work-piece to the user. It also enhances the durability of the angle cutting guide and increases precision in the cutting or mitering because the saw will not cut easily into the saw cutting guides of its side walls.

It is the principal object of this invention to provide a simple, improved angle cutting guide for making miter joints which has structural strength to aid in making accurate joints.

It is a further object of this angle cutting guide to increase the visibility of the work-piece to the user.

It is still another object of this invention to provide an improved angle cutting guide which is simple in construction, convenient and durable in use and helpful in achieving precision in work.

Other objects, features and advantages of this invention will become apparent from a study of the following description read with the accompanying drawing.

DESCRIPTION OF THE PREFERRED EMBODIMENT

Figure 1:
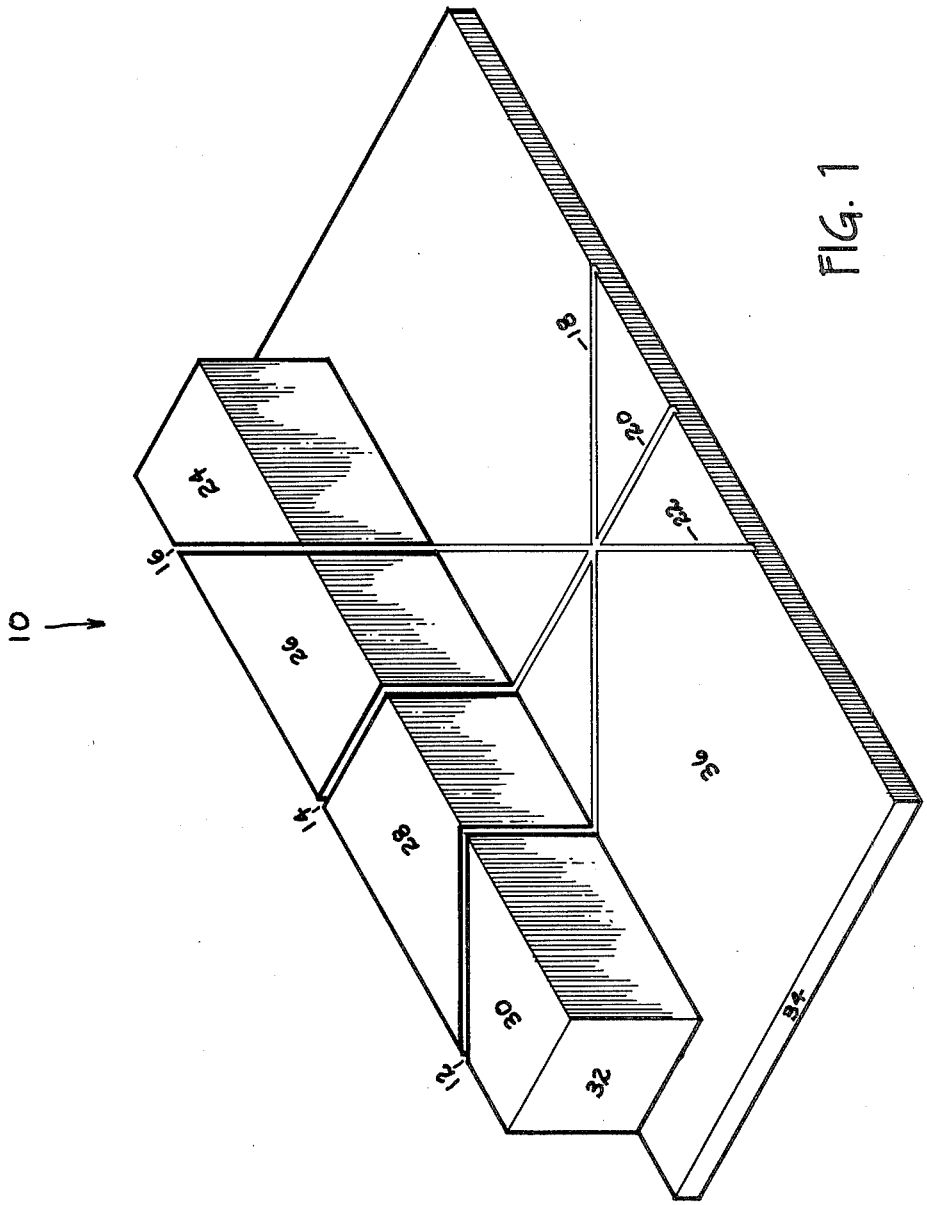
FIG. 1 is a top perspective view of the improved miter box embodying the principles of the present invention.
Figure 2:
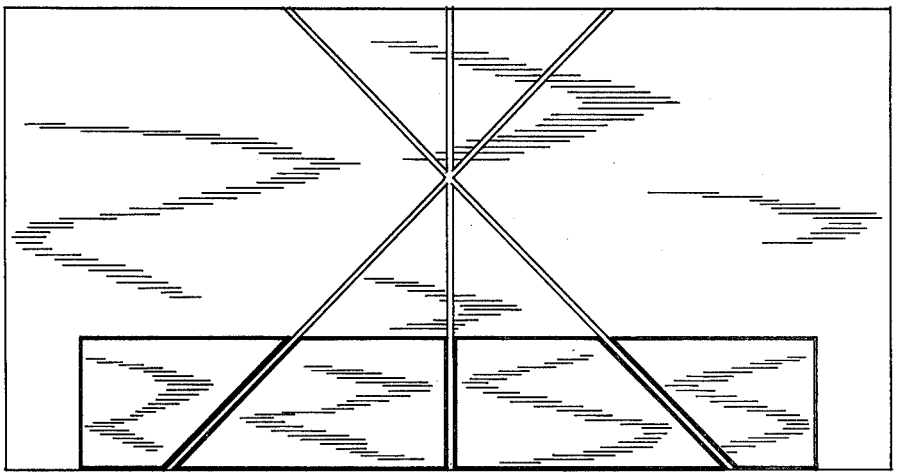
FIG. 2 is another top view of the improved miter box from such a point as to reveal the entire upper portion in a two-dimensional view, and illustrate the angular cutting guides.
Figure 3:
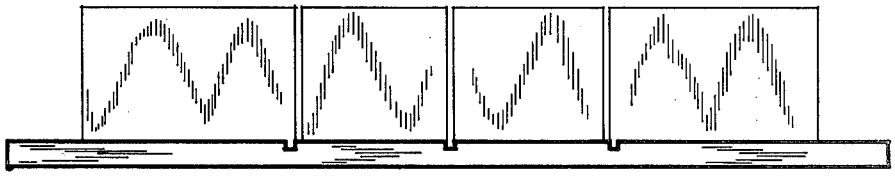
FIG. 3 is a front view of the improved miter box in a two-dimensional effect.
Figure 4:
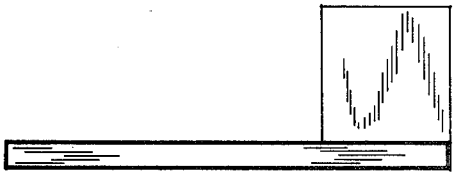
FIG. 4 is a side view of the improved miter box, illustrating the "L" or "bumper" shaped design resulting from the attachment of the one massive saw guide upon the flat base.
Figure 5:
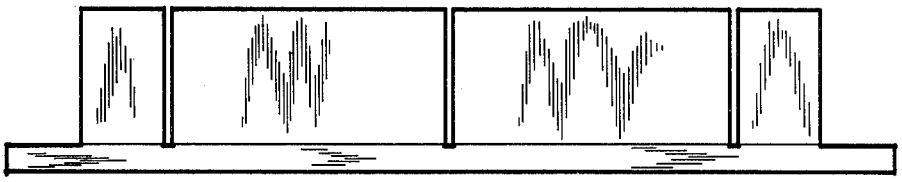
FIG. 5 is a rear view of the improved miter box, exhibiting the mass of the guide upon the base in a two-dimensional drawing, and illustrating the increased distance between the cutting guides when compared to the front view, FIG. 3, due to the angular placement of the cutting guides.

Referring now to the drawing of FIG. 1, the reference numeral 10 denotes generally the miter box of the present invention. The base, numeral reference 36, is a large rectangular board of relatively small thickness, numeral 34, in relation to the massive thickness of the cutting guides, as is illustrated by numeral reference number 32. Base 36 has three slots extending into it to serve as additional cutting guides in mitering the joint. These slots, numerals 18, 20 and 22 are illustrated at three angles, slot 20 being at a 90° angle from the longitudinal axis of the work piece, slot 18 being at a 45° angle, and slot 22 being at a 135° angle respectively. Slots 18, 20 and 22 extend the width of base 36 and are precisely aligned with cutting guides 16, 14 and 12 respectively. The cutting guides 16, 14 and 12 are formed by the spacing and shape of massive blocks 24, 26, 28 and 30 which are positioned on base 36 so as to leave a space between the blocks which aligns with and corresponds to the angles of slots 18, 20 and 22. This space is shown as cutting guides 16, 14 and 12. The blocks 24, 26, 28 and 30, are set near to the edge of base 36. The mass 32 of the blocks provides an effective and accurate guide for the saw as well as lending structural strength to miter box 10, assuring years of productive use. The use of the massive blocks, 24, 26, 28 and 30 make the design simple and easily produced from wood, or any material which is commonly available, yet sturdy and long-lasting.

The construction of miter box 10 provides the user with an unobstructed access to the work piece, thus increasing ease of use and stability of the work piece, and ultimately resulting in greater precision in mitering joints. The absence of the complexities of "U" and box-shaped miter boxes, such as additional sides and tops, results in the work piece being much more easily positioned and, thus, time is saved and efficiency increased.

Thus it will be seen that this invention provides a simple, efficient, durable and useful improvement to the conventional miter box. It is so constructed as to provide greater structural strength than heretofore available, increased visibility of the work-piece and mitering process and increased durability of the angle cutting guide and the saw guide slots. All these advantages are relevant to increased precision in use.

While there has been illustrated and described a single specific embodiment of the present invention, it will be understood that this is by way of illustration only, and that various changes and modifications may be made within the contemplation of the invention and within the scope of the following claim.

I claim:

1. An angle cutting guide, for use in giving a saw a rigid and perfect guide for any degree cut, whether said cut be horizonal or perpendicular, comprising: an elongated base; four elongated solid mass blocks, arranged so as to leave slits as cutting guides between them, and having the appearance of an elongated single solid mass block except for the slits or cutting guides formed by the positions of the blocks said solid mass blocks having a cross section in which the width is substantially equal to the height thereof to provide sufficient guiding surfaces; said blocks are permanently attached to said base along one longitudinal edge of the base only with the longitudinal back side of said solid mass blocks running parallel to the longitudinal edge of said base; the other longitudinal edge of the base being clear a saw guide slot perpendicular to the longitudinal axis of said block and base extending downwards through and from said solid mass block, and partially through said base for 90° cuts; the plurality of diagonally extending saw guides slots extending vertically downwards through said solid mass block and partially through said base for angular cuts.

* * * * *